United States Patent [19]

Aronowitsch et al.

[11] Patent Number: 4,473,021

[45] Date of Patent: Sep. 25, 1984

[54] SPINNAKER BOOM

[76] Inventors: Mikael Aronowitsch, Marknadsvägen 17, 183 34 Täby; Karl Lyth, Reimersholmsgatan 41, 117 40 Stockholm, both of Sweden

[21] Appl. No.: 367,041

[22] Filed: Apr. 9, 1982

[30] Foreign Application Priority Data

Apr. 21, 1981 [SE] Sweden ..... 8102529

[51] Int. Cl.[3] ..... B63H 9/10

[52] U.S. Cl. ..... 114/98; 114/89; 114/39; 114/97; 114/204

[58] Field of Search ..... 114/39, 97, 98, 99, 114/101, 102, 104, 111, 204, 105, 89, 92, 95, 96

[56] References Cited

U.S. PATENT DOCUMENTS

| | | | |
|---|---|---|---|
| 383,172 | 5/1888 | Crandall | 114/97 |
| 3,185,121 | 8/1963 | Nilsen | 114/102 |
| 3,331,348 | 7/1967 | Dyer | 114/112 |
| 3,623,445 | 11/1971 | Holmes | 114/112 |
| 4,059,063 | 11/1977 | Hood et al. | 114/39 |
| 4,080,919 | 3/1978 | Holland et al. | 114/204 |
| 4,292,910 | 10/1981 | Hoyt | 114/102 |

*Primary Examiner*—Trygve M. Blix
*Assistant Examiner*—Edwin L. Swinehart
*Attorney, Agent, or Firm*—Silverman, Cass & Singer, Ltd.

[57] ABSTRACT

A spinnaker boom hingedly attached to the mast of a sailing boat by a traveller. The traveller is movable along the boom so that the boom can be moved relative to the mast substantially transversely to the longitudinal direction of the boat.

5 Claims, 6 Drawing Figures

SPINNAKER BOOM

BACKGROUND OF THE INVENTION

This invention relates to a spinnaker boom intended to be attached to the mast of a sailing boat and by co-action with the spinnaker sheets to contribute to the carrying of the spinnaker.

Sailing with a spinnaker is a very difficult and even a risky element in sailing. This is accentuated with so-called jibing maneuvers, and especially in ocean sailing racing. At a jibe, the direction of the boat in relation to the wind direction is changed, and the spinnaker boom, hereinafter called the boom, is to be moved over from one side of the longitudinal center line of the boat to the other side, and hereby be transferred from co-action with one spinnaker sheet to co-action with another one.

Known booms are arranged and intended so as at one end to be hingedly attached to the mast of the boat, and at the other end to be attached to and run along one of the spinnaker sheets, for example starboard, by means of a hook, loop or the like. At a jibe, the boom is moved over from one side of the boat to the other. This can be effected in that the boom is detached from the sheet, whereafter its free end is turned upward and over to the other side of the boat and thereafter attached to the sheet on that side. Another way of effecting the jibe is that both ends of the boom are detached, and the boom is moved across the longitudinal direction of the boat from one side to the other and attached to the mast and sheet, in such a manner, that the end having been attached to the mast is attached to the sheet, and vice versa.

Irrespective of how the boom is moved over, the movement is carried out substantially manually. The member or members of the crew are on the fore-deck while carrying out the maneuver. This implies, of course, substantial risks, especially in ocean sailing racing. There are great risks that the boom interferes with the spinnaker sheet, other sheets etc., which may imperil the crew and also cause time losses.

SUMMARY OF THE INVENTION

The present invention relates to a spinnaker boom, which at least at certain embodiments is operated from the cockpit or corresponding place on the boat, and which according to the invention solves the aforesaid problems substantially entirely.

The present invention, thus, relates to a spinnaker boom intended to be attached to the mast of a sailing boat by an attachment means.

The invention is characterized in that the attachment means is movable along the boom, so that the boom can be moved relative to the mast substantially transversely to the longitudinal direction of the boat.

BRIEF DESCRIPTION OF THE DRAWINGS

The invention is described in greater detail in the following, with reference to the accompanying drawings, in which.

DESCRIPTION OF THE PREFERRED EMBODIMENTS

Figure 1:
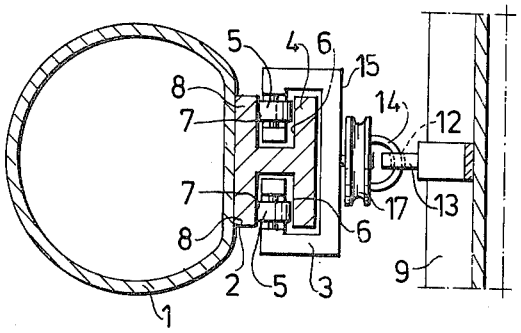
FIG. 1 is a section A—A according to FIG. 2 through a first embodiment of a boom according to the invention attached to a mast.

In FIG. 1 the numeral 1 designates a spinnaker boom according to the invention. The boom is substantially cylindric and preferably tubular, i.e. hollow. 2 designates a rail located at or comprised in the boom and extending along substantially the entire boom 1. Said rail 2 consists, for example, of a profiled so-called sheet rail with substantially I-shaped cross-section.

Along the rail 2 a so-called traveller 3 or corresponding member is intended to run and is preferably of a type known for co-action with a sheet rail 2 and capable of substantially enclosing the flange 4 of the rail 2 located remotest from the boom 1 and by means of preferably four wheels 5 to co-act with the inside 6,7 of the flange 4 and/or the other flange 8, respectively.

Figure 2:
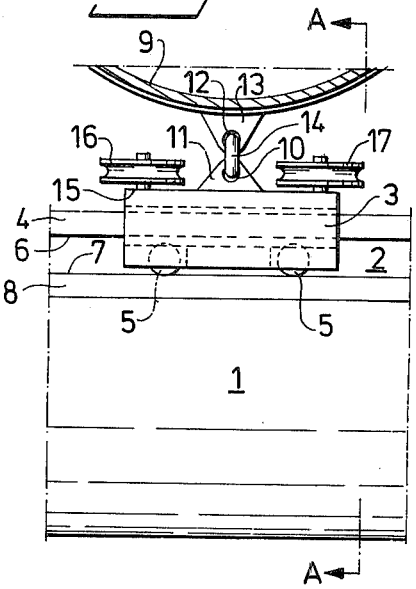
FIG. 2 is a partial view of the boom according to FIG. 1 seen from above in FIG. 1.

Said traveller 3 comprises an attachment means, by which the boom 1 is hingedly attached to the mast 9 of the boat. The attachment means comprises a universal joint or the like to be attached both to the mast 9 and to the traveller 3. In FIGS. 1 and 2 a simple attachment means is shown where a holder 11 with a hole 10 is located on the traveller 3, and a holder 13 with a hole 12 is located on the mast 9, and where a ring 14 or the like co-acts with the holders 11,13 as appears from FIGS. 1 and 2.

The attachment means, thus, is movable along the boom 1, whereby the boom can be moved relative to the mast 9 substantially transversely to the longitudinal direction of the boat.

On the surface of the traveller 3 facing toward the mast 9 two rollers 16,17 are located in alignment with the longitudinal direction of the boom 1. The planes of the rollers are substantially in parallel with the plane of the flanges 4,8 of the I-section.

Figure 3:
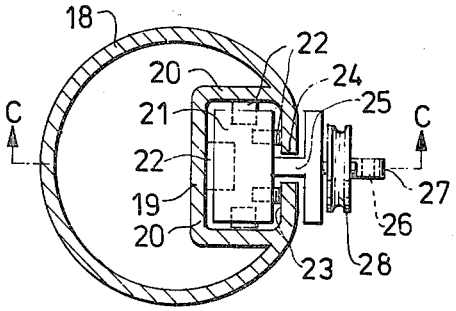
FIG. 3 is a section B—B according to FIG. 4 through a second embodiment of a boom according to the invention.
Figure 4:
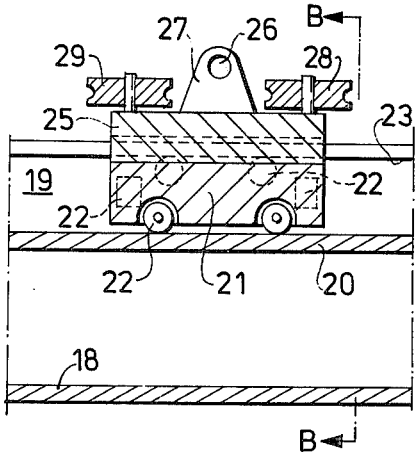
FIG. 4 is a section C—C according to FIG. 3 through the boom according to FIG. 3.

In FIGS. 3 and 4 showing a different embodiment of a boom according to the invention, the numeral 18 designates the boom, which comprises a groove 19 or corresponding detail extending substantially along the entire boom 18. In said groove 19, which preferably has a substantially square cross-section and is defined by three walls 20 located within the boom, a traveller 21 or corresponding member is intended to run and be guided. Said traveller 21 preferably comprises a plurality of wheels 22 or rollers 22 intended to co-act with said walls 20 and with the inner surface 23 of the boom 18.

The traveller 21 comprises a portion 25, which projects out of a slit 24 in the boom and at which a holder 27 with a hole 26 and two rollers 28,28 are located in the manner and for the object corresponding to the embodiment shown in FIGS. 1 and 2.

Figure 5:
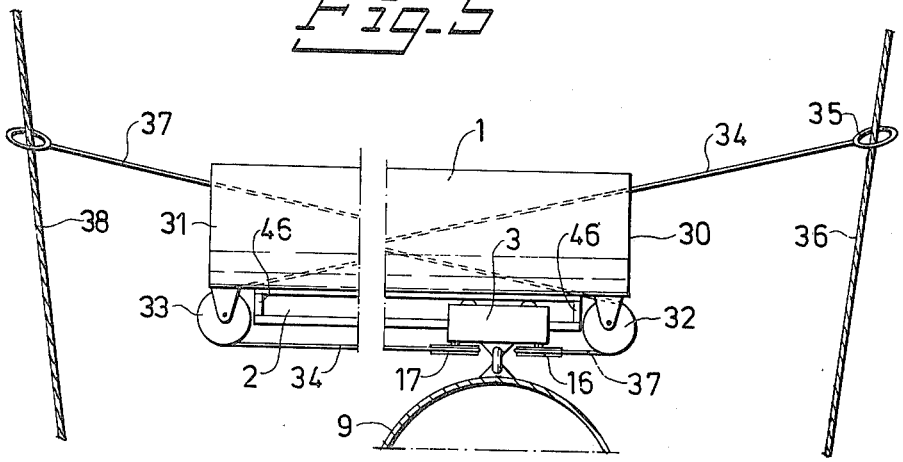
FIG. 5 shows a boom according to FIG. 1 seen from above where wires for operating the boom are arranged to co-act with the spinnaker sheet.

In FIG. 5 an embodiment of a boom according to the invention is shown, which is operated by wires or corresponding means preferably from the cockpit of the boat. In FIG. 5 the embodiment according to FIGS. 1 and 2 is shown, but, of course, the embodiment according to FIGS. 3 and 4 can be used in a corresponding way.

For this purpose, each boom end 30,31 comprises both starboard 30 and port 31, a roller 32 and, respectively, 33. The numeral 34 designates a first steel wire or corresponding detail intended to be attached to the starboard spinnaker sheet 36 by means of a ring 35 or the like, to run into the boom 1 at the starboard boom end 30, to continue through the boom 1 over to the port roller 33, thereafter preferably to the port roller 17 of the traveller and to continue running, preferably along the forward edge of the mast and via one or more roller(s) on deck, preferably to the cockpit. The numeral 37 designates a second steel wire or corresponding detail intended to be attached in a corresponding manner to the port spinnaker sheet 38 and to run in a corresponding manner from the sheet 38 to the cockpit via the port boom end 31, starboard roller 32 and starboard roller 16 of the traveller.

Figure 6:
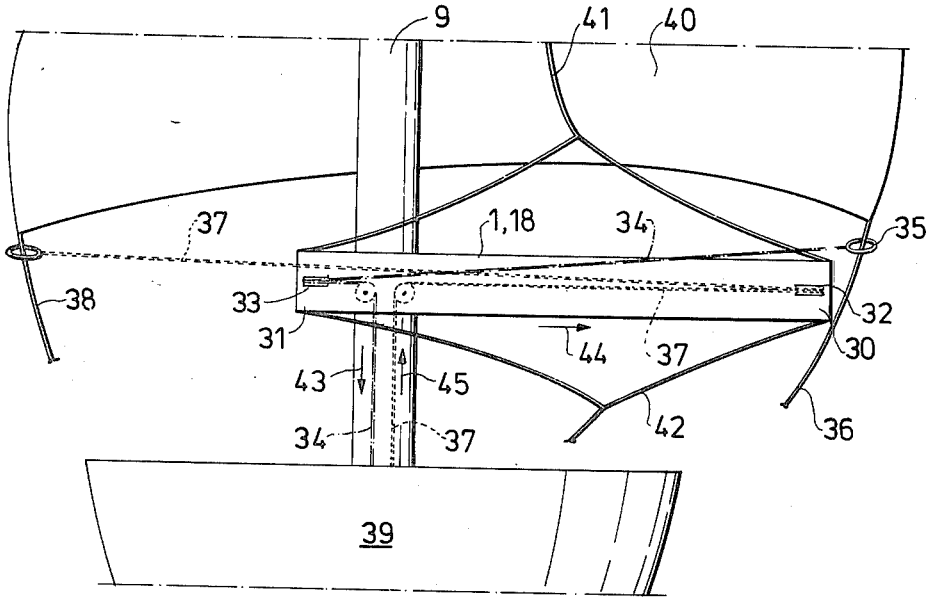
FIG. 6 shows schematically the boom and arrangements according to FIG. 5 seen from the stern.

In FIG. 6 the boat seen from the stern is designated by 39 and the spinnaker is designated by 40. Said first steel wire is shown by dash-dotted line, and said second wire by dashed line. The boom and other arrangements are shown only schematically. 41 designates a normal tricing line co-acting with the boom, and 42 is a normal downhaul.

The mode of operation of the spinnaker boom according to the invention should have become apparent from the above description.

The boom, thus, can be moved relative to the mast transversely to the longitudinal direction of the boat by the attachment means movable along the boom. In the simplest case the movement is effected manually, in that the boom either is detached from the sheet, to which it is attached, and is moved over across the boat and attached to the other sheet, or it is moved over and attached to the other sheet before it has been detached from the first sheet. The boom very well may be a normal boom completed with a rail 2 of the kind described above.

The mode of operation of the embodiment operated by wires is as follows, see FIG. 6. It is assumed that the boom 1 originally was in port position and is to be moved over to starboard position, i.e. substantially the position shown in FIG. 6. For this purpose, the wires 34,37 are loosened. Thereafter the wire 34 is taken home, i.e. drawn in the direction indicated by the arrow 43. Hereby the starboard sheet 36 is drawn in the direction to the starboard boom end 30 all the way until the ring 35 arrives at the boom end. The ring is designed so that it cannot be moved into the boom. Thereafter, instead, the boom will move and hereby is moved from port to starboard, arrow 44. The Figure shows a position during this movement. The boom is moved a.o. due to the fact that the attachment means is attached to the mast but movable along the boom. The wire 37 runs out, arrow 45, to an extent determined a.o. by the port sheet.

The boom can be caused in a corresponding manner to move from starboard to port by taking home the wire 37.

As should have become apparent from the aforesaid, a boom according to the invention solves to a substantial extent or substantially entirely the problems arising at jibing maneuvers when sailing with a spinnaker. Manual operation of the boom is facilitated substantially, in that the boom all the time is attached to the mast and can be moved across the boat and be attached to a new sheet before it is detached from the first sheet, if so desired. Hereby the boom is prevented from interfering with other sheets etc. No complicated situations can arise at which the boom is detached entirely from both mast and sheet.

At wire operation, the boom is moved entirely without manual work to be carried out on the fore-deck. This implies great advantages and less risk.

Some embodiments of a spinnaker boom according to the invention have been described above. It is, of course, possible to imagine more embodiments and minor changes without abandoning the idea of the invention.

The traveller, for example, as mentioned can be attached to the mast by means of a universal joint of known kind where one part of the joint is attached to the mast and one part is attached to the traveller.

A plurality of designs of end stop members 46, furthermore, can be provided at the rail 2 or in connection to the groove 19 in order to prevent the traveller from sliding off the boom.

In FIG. 5 rollers 32,33 are shown located externally where the respective wire runs out of the boom through slits or the like (not shown). The rollers can also be located within the boom, which may be expedient at embodiments according to FIGS. 3 and 4.

In order to ensure that the wires run easily into and out of the boom, the boom can be provided at each end 30,31 with special means, such as well rounded end pieces, possibly exchangeable and in connection to the end surfaces of the boom coated with Teflon or the like. It also can be imagined to position three rollers offset through 120° relative to each other where one wire runs to a large extent enclosed by the three rollers.

In the above description a profiled rail 2 with I-shaped cross-section has been stated. Of course, a rail with, for example, X-shaped cross-section, and even other cross-sections, can be imagined.

The invention, thus, must not be regarded restricted to the embodiments set forth above, but can be varied within the scope of the attached claims.

We claim:

1. A spinnaker boom for partially supporting a spinnaker sail on the mast of a sailing vessel, said boom including an elongated body portion and means for interconnecting said boom to selected portions of a spinnaker sail system, mounting means for securing said boom to said mast including both sliding and swiveling components configured to permit sliding boom movement transverse to the longitudinal axis of said mast to shift said boom and at least a portion of said spinnaker sail system between a first position on one side of said mast and a second position on the opposite side of said mast while maintaining mast attachment and permitting simultaneous swiveling of said boom with respect to said mast to accommodate changing wind forces applied to said spinnaker sail system while maneuvering said vessel, said sliding component including traveler means slidably interconnecting said boom and mast and with respect to which said boom may move between said first and second positions substantially throughout its length, said traveler means being secured to said mast by said swiveling component to permit limited pivotal and rotational movement to accomodate varying wind forces.

2. A spinnaker boom as claimed in claim 1 and wherein said sliding component includes a traveller movable along substantially the entire length of the boom, and said swiveling component includes a universal joint attached to the mast and the traveller.

3. A spinnaker boom as claimed in claim 2 including a rail positioned on the boom, said traveller being adapted for movement on said rail, the rail being of generally I-shaped cross-sectional configuration.

4. A spinnaker boom as claimed in claim 2 in which the boom has a groove along the length thereof, said traveller being positioned within the groove for movement therein.

5. A spinnaker boom as claimed in claim 2 in which the boom is hollow and each boom end includes a roller, said traveller including two rollers, a starboard spinnaker sheet and a port spinnaker sheet, a first wire attached to the starboard spinnaker sheet and passing into the interior of the boom at the starboard boom end and continuing through the boom to and over the roller at the port boom end, the first wire passing from the roller at the port boom end to one of the traveller rollers and continuing along the forward edge of the mast past one or more other rollers on the boat deck to the boat cockpit, a second wire attached to the port spinnaker sheet and passing into the interior of the boom at the port boom end and continuing through the boom to and over the roller at the starboard boom end, the second wire passing from the roller at the starboard boom end to the other of the traveller rollers and continuing along the mast past one or more other rollers on the deck to the cockpit, whereby the boom is movable from the cockpit by the wires substantially across the longitudinal direction of the boat.

* * * * *